United States Patent [19]

Weber

[11] Patent Number: 4,836,008

[45] Date of Patent: Jun. 6, 1989

[54] SOLENOID POWERED RIVETING TOOL

[75] Inventor: Richard G. Weber, Ridgefield, Conn.

[73] Assignee: Emhart Industries, Inc., Farmington, Conn.

[21] Appl. No.: 300,147

[22] Filed: Jan. 23, 1989

Related U.S. Application Data

[63] Continuation of Ser. No. 139,356, Dec. 30, 1987, abandoned.

[51] Int. Cl.[4] ..... B21J 15/24

[52] U.S. Cl. ..... 72/391; 72/430; 227/131

[58] Field of Search ..... 72/391, 114, 430; 29/243.53; 227/131

[56] References Cited

U.S. PATENT DOCUMENTS

| | | | |
|---|---|---|---|
| 1,365,664 | 1/1921 | Cox | 72/430 |
| 3,119,507 | 10/1961 | Burritt | 218/43 |
| 3,127,045 | 2/1962 | Tschantz | 218/42 |
| 3,095,106 | 6/1963 | Morrison | 218/42 |
| 3,254,522 | 6/1966 | Elliott | 72/391 |
| 3,359,777 | 12/1967 | Lee | 72/391 |
| 3,442,105 | 5/1969 | Sosnowicz et al. | 72/391 |
| 3,504,519 | 4/1970 | Hornung | 72/391 |
| 3,626,745 | 12/1971 | Richardson | 72/391 |
| 3,646,791 | 3/1972 | Leftheris | 72/56 |
| 3,822,595 | 7/1974 | Elflein | 72/391 |
| 4,085,337 | 4/1978 | Moeller | 307/115 |
| 4,128,000 | 12/1978 | Hogenhout et al. | 72/430 |
| 4,151,735 | 5/1979 | McDermott | 72/430 |
| 4,321,814 | 3/1982 | Martin | 72/114 |
| 4,517,820 | 5/1985 | Oefinger | 72/321 |
| 4,559,806 | 12/1985 | Schwab | 72/391 |

FOREIGN PATENT DOCUMENTS

| | | | |
|---|---|---|---|
| 1,370,001 | 10/1974 | United Kingdom. | |
| 3617191 | 7/1987 | France | 72/391 |

*Primary Examiner*—David Jones

*Attorney, Agent, or Firm*—Thomas S. Szatkowski

[57] ABSTRACT

A solenoid actuated blind rivet tool having pulling impulse intensifying apparatus co-acting with the mandrel pulling mechanism. One type of impulse intensifying mechanism is a slidable connection of the tool's nose housing, housing the assembly for engaging and tensioning the mandrel, and power chamber which comprises the remainder of the tool housing, which power chamber carries a solenoid for powering the tool. The solenoid pulls the nose housing rearwardly until it impacts against the power chamber, creating a high-magnitude impulse force to break the mandrel. In lieu of a slidably mounted nose piece, the tool may include a member linked to the pulling mechanism and a ram which is driven against the member by the solenoid thereby creating an impulse force which is transmitted to the pulling mechanism.

13 Claims, 2 Drawing Sheets

SOLENOID POWERED RIVETING TOOL

This is a continuation of co-pending application Ser. No. 139,356, filed on Dec. 30, 1987, now abandoned.

BACKGROUND OF THE INVENTION

This invention relates to blind rivet tools and more particularly to blind rivet tools having an electromagnetic solenoid for actuating the rivet pulling mechanism.

In the field of tools for setting blind rivets, it is conventional to use a pneumatic or hydraulic power source to pull the mandrel of the rivet to set the rivet and break the mandrel stem. An example of such a tool is shown in commonly owned U.S. Pat. No. 4,517,820.

Attempts have been made to use an electric power source to set a blind rivet. However, these devices require a gear reduction mechanism to obtain sufficient pulling force to break the mandrel stem. An example of such a blind rivet tool is shown in U.S. Pat. No. 3,095,106. Tools of this type have longer rivet setting cycles than the pneumatic or hydraulic type.

Another attempt at using an electric power source is shown in U.S. Pat. No. 3,646,791 wherein a stress wave is passed through the rivet to render it momentarily plastic so the rivet can be set.

It is the purpose of the invention to provide an improved blind rivet tool utilizing an electromagnetic power source for the pulling mechanism of the tool.

SUMMARY OF THE INVENTION

In realizing the foregoing and additional objects, the invention utilizes a solenoid to operate a rivet engaging and pulling mechanism of a blind rivet tool, with an impulse intensifier creating a large impulse force to break the stem of the mandrel of a blind rivet.

In its first embodiment, the invention provides a slidable interconnection between a nosepiece for housing the pulling mechanism, and a "power chamber" for housing the remaining tool components including the solenoid. The force induced by the solenoid on the nose housing-pulling mechanism draws these structures toward the solenoid and causes the nose housing and power chamber to collide after the initial operation of the pulling mechanism of the tool. This impact creates an intensified impulse force to break the mandrel stem of a blind rivet. The solenoid pulling force should accelerate and decelerate in a brief enough time, and the moving components should have enough mass, to create a sufficiently large impulse force to break the mandrel.

A version of this embodiment fixedly mounts the solenoid coil within the power chamber and the solenoid plunger is drawn rearwardly to draw back the pulling mechanism of the tool. Advantageously, the power chamber includes a sleeve, the nosepiece being mounted to slide on the sleeve in a direction generally axial to the fastener.

In a second embodiment of the invention, the solenoid is reciprocably mounted within the tool body. The solenoid, when energized rearwardly, drives a ram until this abuts against a member which is linked to the rivet pulling mechanism, creating an impulse which serves to break the mandrel stem. Advantageously, the action of the solenoid on the ram prior to such impact causes the tensioning of the mandrel stem. For this purpose, a spring or other biasing means may be interposed between the ram and the member so that the solenoid force on the ram is transmitted to the member during such period prior to impact.

In a variation of the second embodiment, the rivet mandrel gripping and tensioning assembly may be modified, or a different type of rivet may be employed, to reduce or eliminate the need for the rivet mandrel stem for tensioning the mandrel.

DETAILED DESCRIPTION OF THE EMBODIMENTS

Figure 2:
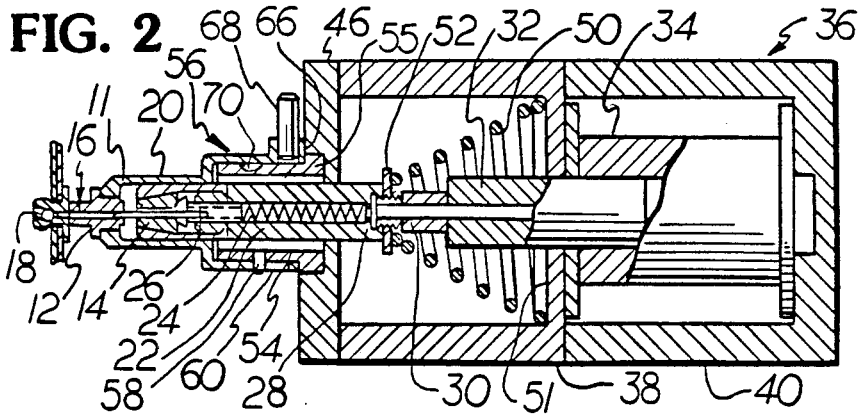
FIG. 2 is a sectional view of the tool embodiment of FIG. 1 showing the position of the nose housing after the solenoid has been energized to draw the pulling mechanism and slidable nose housing to the position at which the impulse force is generated.
Figure 1:
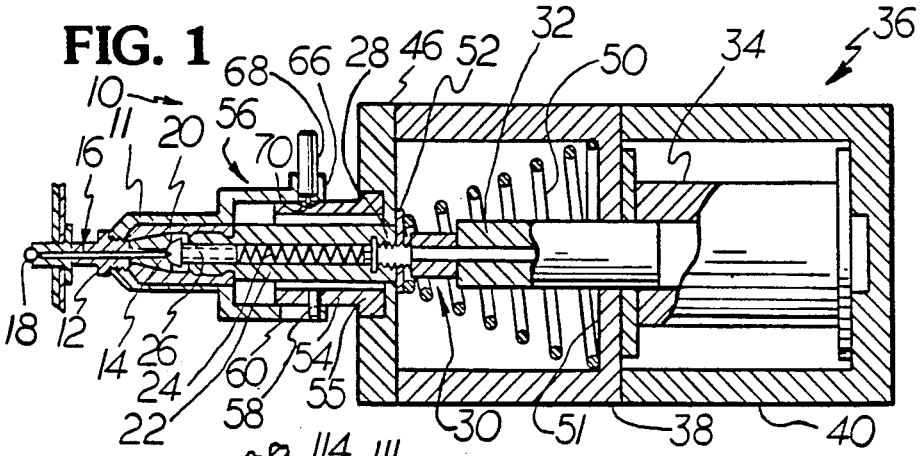
FIG. 1 is a sectional view of the blind rivet tool of a first embodiment of this invention, in its rest configuration.

Reference should be made to FIGS. 1 and 2 which illustrate a solenoid-powered blind rivet tool in accordance with a first embodiment of the invention. The blind rivet tool 10 of this embodiment contains a nose housing 11 into which a conventional nose piece 12 is threaded (See FIG. 1). Positioned in the nose housing 11 is a pair of jaws 14 which are adapted to grip the mandrel stem 16 of the blind rivet 18 in the conventional manner disclosed in commonly assigned U.S. Pat. No. 3,254,522. The jaw guide 20 surrounds the jaws 14 and is attached to the draw bar 22. The spring 24 is positioned in the draw bar 22 and biases the jaw pusher 26 to maintain the jaws 14 open to accept insertion of the mandrel stem 16. When the mandrel stem 16 is inserted into the nose piece 12 and jaws 14, a rearward force on the draw bar 22 will pull the mandrel stem and set the blind rivet.

Threaded into the rear 28 of draw bar 22 is the front end 30 of the core 32 of the solenoid 34, these structures being retained in the housing 36 of the tool. The tool housing or power chamber 36 comprises a rear portion 40 and a forward portion 38 which is secured to rear portion 40 by any convenient means. A conical spring 50 is biased between the wall 51 of the forward portion 38 of the housing 36 and a washer 52 positioned on the rear of the draw bar 22. The spring 50 biases the draw bar 22 toward the front of the tool.

A sleeve 54 has a flange 55 positioned in the end cap 46 and surrounds the draw bar 22. The nose housing 11 has an enlarged rear portion 56 slidably disposed about the sleeve 54. A guide pin 58 in sleeve 54 rides in the slot 60 of the nose housing 11 to maintain the nose housing 11 and sleeve 54 axially aligned.

In operation, as the solenoid 34 is energized, the solenoid core 32 will be drawn rearwardly (See FIG. 2). This will cause the enlarged rear portion 56 of nose housing 11 to move rearwardly until the shoulder 66 abuts the flange 55 on sleeve 54. At this instant, the pulling force of the solenoid 34 will be intensified to break the mandrel stem. The magnitude of the impulse force resulting from this abutment increases in proportion to the mass which accelerates and decelerates in conjunction with the rivet gripping and tensioning mechanism, and increases inversely with the square of the time interval over which acceleration and deceleration occurs.

Mounted on the rear portion 56 of nose housing 11 is a spring biased pin 68 which is positioned in the detent 70 in the sleeve 54. After the rivet is set and the solenoid released, the spring 50 will return the nose housing 11 to the forward position and the pin 68 will re-engage the detent 70 to eliminate any bounce of the nose piece on its return to the forward position.

It can thus be seen with the sliding interconnection of the sleeve 54 and nose housing 11, as the shoulder 66 on nose housing 11 abuts flange 55 on the sleeve 54, the pulling force of solenoid will be momentarily intensified to set the rivet and break the mandrel stem.

Figure 3:
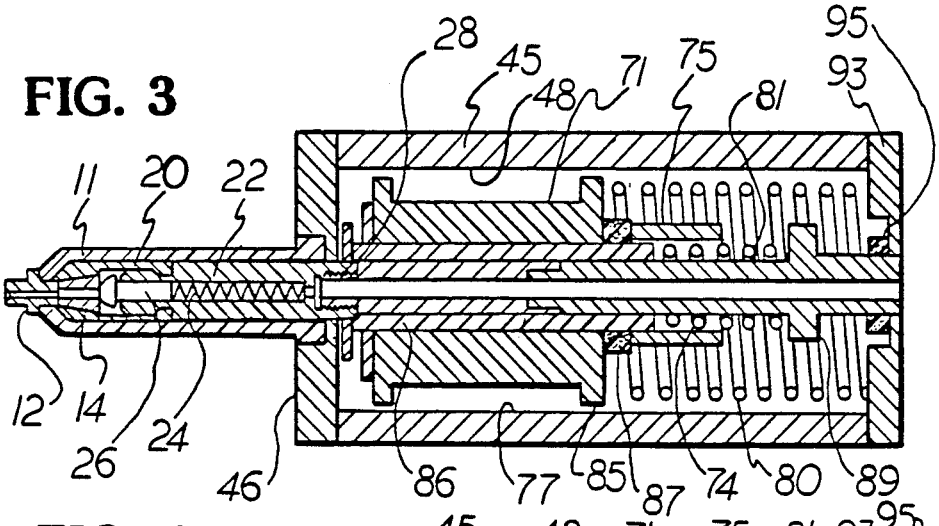
FIG. 3 is a sectional view of a blind rivet tool according to a second embodiment of the invention, in its rest configuration.
Figure 4:
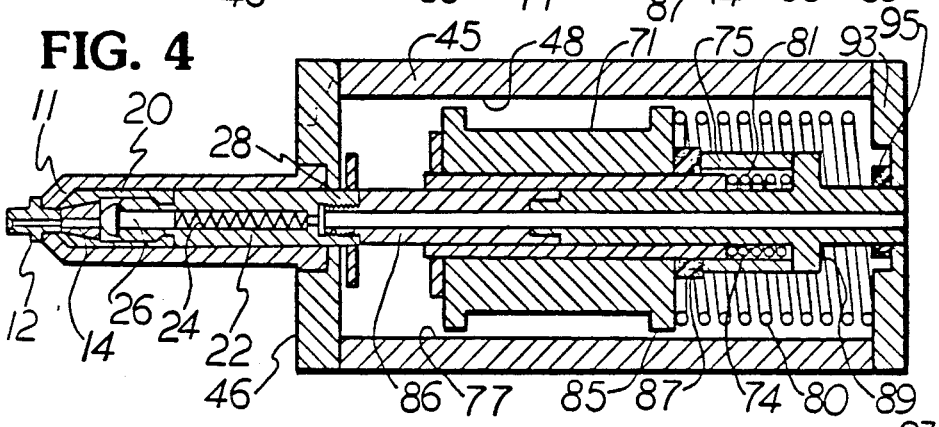
FIG. 4 is a sectional view of the tool of FIG. 3, in its jaw tensioning configuration.
Figure 5:
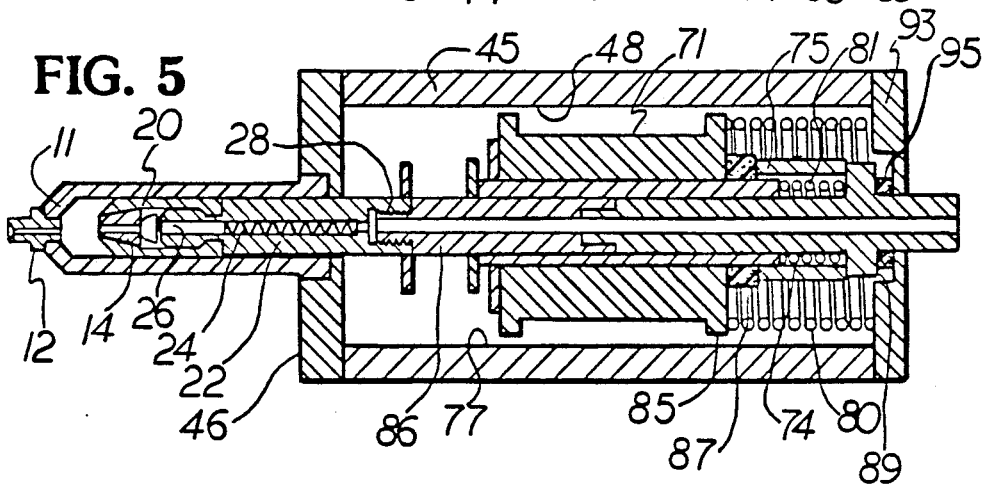
FIG. 5 is a sectional view of the tool of FIG. 3, in its impulse force configuration.

A second embodiment of the invention is illustrated in the sectional views of FIGS. 3–5, in which like numerals refer to structures corresponding to those shown in FIGS. 1 and 2. This second tool incorporates a fixed nosepiece and conventional mandrel pulling mechanism in accordance with commonly assigned U.S. Pat. No. 3,254,522, and utilizes a movable solenoid-ram structure to provide an impulse force within the tool in lieu of that provided by the movable nosepiece in the embodiment of FIG. 1. This arrangement avoids the disadvantage that movement of the nosepiece away from the workpiece complicates the setting of a rivet therein.

Solenoid 71 is slidably mounted within the housing 45 the inner wall of which is suitably machined for this purpose. Solenoid 71 is slidably mounted around alloy steel tube 74; retaining member 77 (illustratively comprised of an E ring) is fitted to tube 74 after sliding solenoid 71 thereon. Steel tube 74 in turn is slidably mounted around hollow steel rod 85, which includes a forward portion 86 threaded into draw bar 22 and a rear portion 87 slidably mounted in the rear cap 47 of power chamber 45. A ring 73 of dampening material (such as a foam polymer) and an alloy steel tube 75 (or, in functional terms, "ram") are secured around steel tube 74 at the rear of solenoid 71. Steel tubes 74 and 75 provide high mass and magnetic characteristics suited to the operation of tool 70. Solenoid 71 is forwardly biased by outer compression spring 80, while steel tube 74 (with affixed structures 73 and 75) is forwardly biased relative to steel rod 85 by the inner compression spring 81 placed between rod 74 and the flange portion 89 of rod 85.

In the initial, rest position shown in FIG. 3, solenoid 71 and tube 74 are in their forward locations due to the action of springs 80 and 81. Upon energizing solenoid 71, it presses against pliant ring 73 and steel tube 75, overcoming the respective spring forces to drive tubes 74 and 75 rearwardly until ram 75 impacts against flange 89. During this period, illustrated in FIG. 4, the compression of spring 81 exerts a rearward force on flange 89 which produces rearward motion of rod 85, draw bar 22, and jaw guide 20 while causing jaws 14 to bite into and tension the mandrel stem 16. At the point of impact between ram 75 and flange 89, illustrated in FIG. 5, an impulse force is generated and transmitted to the jaws 14 via jaw guide 20 in order to break the mandrel stem 16. Thereafter the solenoid drives rod 85 rearwardly until flange 89 rests against the dampening material 95 at the rear of tool 70. Deenergizing solenoid 71 permits the return of these mechanisms to their rest configuration of FIG. 3.

The embodiment of FIGS. 3-5 shows a colinear, fixed connection between the rod 85 and the pulling mechanisms in nose housing 11, wherein rod 85 acts as an energy transfer member to transmit the impulse force. It should be recognized, however, that other mechanical linkages may be employed for this purpose. For example, the solenoid and related structures for generating the impulse force could be located in a tool handle at an angle to the nosepiece, and would be coupled to the draw bar by a translation-to-translation linkage.

Figure 6:
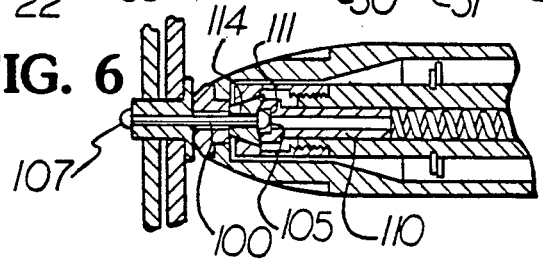
FIG. 6 is a sectional view of the nose piece portion of an alternative version of the tool of FIGS. 3–5, in its rest position, shown engaging a double-headed rivet seated in a workpiece.
Figure 7:
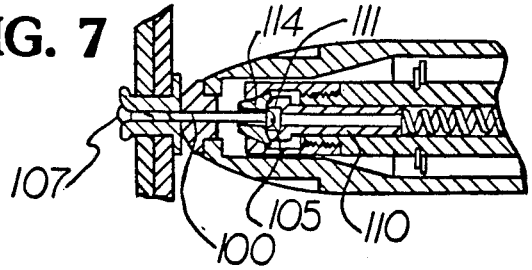
FIG. 7 is a sectional view corresponding to the view of FIG. 6, showing the rivet pulling mechanism drawn rearwardly to set the rivet.

The embodiments of FIGS. 1–5 have been illustrated using the mandrel pulling mechanism of U.S. Pat. No. 3,254,522 to engage and tension a conventional single-headed rivet 18 (i.e. one having only a rivet-setting head 19). One may also adapt the apparatus of the invention for use with a double headed rivet, such as that disclosed in commonly assigned UK patent publication No. 2149709. FIGS. 6 and 7 show in section an alternative nose piece arrangement for engaging and tensioning a rivet 100 which has a pulling head 105 in addition to the rivet setting head 107. In this embodiment the jaw pusher 110 includes a clearance region 111 to accommodate pulling head 105. Rearward motion of the rivet tensioning mechanisms causes jaws 114 to engage and pull back pulling head 105, for setting of the rivet and breaking of the mandrel stem, in accordance with UK patent publication No. 2149709. By eliminating the need for gripping of the mandrel by the jaws 114, this embodiment reduces or eliminates the need for tensioning the mandrel stem for gripping purposes in the embodiment of FIGS. 3–5, and facilitates the breaking of the mandrel stem which would depend essentially on the sudden pulling back on pulling head 105 at the time of generating the impulse force.

I claim:

1. An electromagnetically powered blind rivet setting tool comprising:

rivet engaging means for engaging a rivet mandrel sliding element means for moving with said rivet engaging means between advanced and retracted positions, said sliding element means comprising a nose housing in which said rivet engaging means is located;

stop means for colliding with said sliding element means when said rivet engaging means reaches the retracted position to provide an impulse force, said stop means comprising a sleeve, said nose housing being slideably mounted thereto;

solenoid means linked to said rivet engaging means for moving said rivet engaging means and sliding element means and adapted such that upon energizing said solenoid means, said sliding element means moves with said rivet engaging means from the advanced to the retracted position;

wherein said sliding element means and rivet engaging means have sufficient mass, and said solenoid means has sufficient pulling force to accelerate said sliding element means and rivet engaging means such that upon collision with said stop means a sufficiently large impulse force is created to break the rivet mandrel.

2. The rivet setting tool of claim 1 wherein said solenoid means is housed in a power chamber located adjacent said sleeve.

3. The tool of claim 1 further comprising means for maintaining the sleeve and nose housing in axial alignment.

4. The tool of claim 1 further comprising a spring biased pin on said nose housing engagable with a detent on said sleeve.

5. The tool of claim 2 wherein the nose housing mounted to the sleeve so as to slide parallel to the major axis of the rivet.

6. The tool of claim 1 wherein the rivet engaging means includes a pair of jaws, a jaw guide for causing the jaws to grip the mandrel when said jaw guide is pulled, and a draw bar for pulling the jaw guide, said draw bar being linked to a solenoid plunger.

7. An electromagnetically powered blind rivet setting tool comprising:

rivet engaging means for engaging a rivet mandrel;

sliding element means for moving said rivet engaging means between advanced and retracted positions, said sliding element means comprising a member attached to said rivet engaging means and a ram in sliding engagement with said member;

stop means for colliding with said sliding element means when said rivet engaging means reaches the retracted position to provide an impulse force;

solenoid means linked to said sliding element means for moving said sliding element means and adapted such that upon energizing said solenoid means, said sliding element means moves said rivet engaging means from the advanced to the retracted position;

wherein said sliding element means and rivet engaging means have sufficient mass, and said solenoid means has sufficient pulling force to accelerate said sliding element means and rivet engaging means such that upon collision with said stop means a sufficiently large impulse force is created to break the rivet mandrel.

8. The rivet setting tool of claim 7 wherein said solenoid means is slideably mounted upon said member.

9. The rivet setting tool of claim 7 wherein said stop means comprises a flange located upon said member at the end thereof, opposite the end which is attached to said rivet engaging means.

10. A tool as defined in claim 9, further comprising a spring interposed between the ram and the member wherein the driving of the ram towards the member causes the rivet engaging means to tension the rivet mandrel prior to the collision of said ram and said stop means.

11. A tool as defined in claim 9 further comprising a housing, said solenoid being slidable mounted within said housing to move generally axially to said rivet.

12. An electromagnetically powered blind rivet setting tool comprising:

a power chamber containing a solenoid;

a rivet engaging means for engaging a rivet mandrel, said rivet engaging means located within a nose housing, said nose housing being slideably mounted to a sleeve mounted upon said power chamber and adapted to slide between advanced and retracted positions;

stop means comprising said sleeve for colliding with said nose housing when said nose housing reaches the retracted position;

said solenoid having a plunger which is linked to said rivet engaging means so that, upon energizing the solenoid, the plunger pulls the nose housing and rivet engaging means from the advanced to the retracted position;

said nose housing, rivet engaging means, and plunger having sufficient mass and said solenoid having sufficient pulling force to accelerate said nose housing, rivet engaging means and plunger such that, upon collision of said nose housing with said stop means, a sufficiently large impulse force is created to break said rivet mandrel.

13. An electromagnetically powered blind rivet setting tool comprising:

a rivet engaging means for engaging a rivet mandrel;

an elongated member having an outwardly projecting annular flange stop means at one end thereof and secured to said rivet engaging means at the other end;

means for supporting said member for axial displacement from an advanced position for contacting the mandrel of a rivet to a retracted position when the rivet body has been deformed and the mandrel broken;

a solenoid for slideably receiving said member, said solenoid being located on said member intermediate said rivet engaging means and said annular flange;

a ram slideably mounted on said member and located between said solenoid and said annular flange;

spring means located upon said member between said solenoid and said annular flange for maintaining said solenoid at a selected distance from said annular flange stop means;

means for energizing said solenoid thereby causing it to move toward said annular flange wherein said solenoid has sufficient pulling force that upon collision of said ram with said annular flange a sufficiently large impact force is created to break said mandrel.

* * * * *